US011329371B2

(12) United States Patent
Lin et al.

(10) Patent No.: US 11,329,371 B2
(45) Date of Patent: May 10, 2022

(54) ANTENNA DEVICE INCLUDING ANTENNA AND SUBSTRATE GENERATED WITH NON-OPAQUE MATERIAL

(71) Applicant: MEDIATEK INC., Hsin-Chu (TW)

(72) Inventors: Wun-Jian Lin, Hsinchu (TW); Shyh-Tirng Fang, Hsinchu (TW); Shih-Huang Yeh, Hsinchu (TW)

(73) Assignee: MEDIATEK INC., Hsin-Chu (TW)

( * ) Notice: Subject to any disclaimer, the term of this patent is extended or adjusted under 35 U.S.C. 154(b) by 0 days.

(21) Appl. No.: 17/030,313

(22) Filed: Sep. 23, 2020

(65) Prior Publication Data

US 2021/0119329 A1 Apr. 22, 2021

Related U.S. Application Data

(60) Provisional application No. 62/916,356, filed on Oct. 17, 2019.

(51) Int. Cl.

| | |
|---|---|
| ***H01Q 1/38*** | (2006.01) |
| ***H01Q 1/22*** | (2006.01) |
| ***H01Q 1/24*** | (2006.01) |
| ***H01Q 25/00*** | (2006.01) |
| ***H01Q 19/10*** | (2006.01) |

(52) U.S. Cl.

CPC ..... *H01Q 1/38* (2013.01); *H01Q 1/2283* (2013.01); *H01Q 1/243* (2013.01); *H01Q 19/10* (2013.01); *H01Q 25/00* (2013.01)

(58) Field of Classification Search

CPC ..... H01Q 1/38; H01Q 1/2283; H01Q 1/243; H01Q 19/10

USPC ..... 343/879

See application file for complete search history.

(56) References Cited

U.S. PATENT DOCUMENTS

2007/0008238 A1* 1/2007 Liu ..... H01L 23/49855 343/895
2011/0279340 A1* 11/2011 Kato ..... H01Q 1/2208 343/793
2015/0129114 A1* 5/2015 Lin ..... C23C 16/56 156/145
2015/0235121 A1* 8/2015 Pavate ..... G06K 19/07783 235/492

* cited by examiner

*Primary Examiner* — Peguy Jean Pierre
(74) *Attorney, Agent, or Firm* — Winston Hsu

(57) ABSTRACT

An antenna device includes a substrate, a feed line and an antenna. The substrate is formed with a non-opaque material. The feed line is disposed at the substrate and has a first terminal and a second terminal. The antenna is disposed at the substrate, electrically connected to the first terminal of the feed line, and is used to access a wireless signal. The second terminal of the feed line is electrically connected to a chip disposed on the substrate.

19 Claims, 6 Drawing Sheets

ANTENNA DEVICE INCLUDING ANTENNA AND SUBSTRATE GENERATED WITH NON-OPAQUE MATERIAL

CROSS REFERENCE TO RELATED APPLICATIONS

This application claims priority to provisional Patent Application No. 62/916,356, filed Oct. 17, 2019, and incorporated herein by reference in its entirety.

BACKGROUND

As the demand of wireless communications increases and the technology advances, the requirements related to antennas also grow. For example, a common application of wireless communications is related to portable devices.

A portable device often includes a display panel and a set of antenna(s). The size and weight of a portable device are usually limited, and it is difficult to reduce the overall volume of the device after the antenna and the display panel are installed together.

In addition, since the position of the antenna is difficult to be adjusted on the device, it becomes a hard task to improve the antenna (radiation) pattern.

A solution for reducing the size of the device without affecting the transceiver ability and deteriorating the antenna performance is in need in the field.

SUMMARY

An embodiment provides an antenna device including a substrate, a feed line and an antenna. The substrate is generated with a non-opaque material. The feed line is disposed at the substrate and has a first terminal and a second terminal. The antenna is disposed at the substrate, electrically connected to the first terminal of the feed line, and used to access a wireless signal. The second terminal of the feed line is electrically connected to a chip disposed on the substrate.

These and other objectives of the present invention will no doubt become obvious to those of ordinary skill in the art after reading the following detailed description of the preferred embodiment that is illustrated in the various figures and drawings.

DETAILED DESCRIPTION

In order to reduce the whole volume of the device, improve the flexibility of disposing the antenna(s) and avoid deteriorating transceiving performance, embodiments may provide antenna devices as followings. In the text, when an element A (hereinafter A) is described to be disposed at an element B (hereinafter B), it means A may be disposed on the surface of B or be embedded inside B. When A is described to be disposed on B, it means A may be disposed on the surface of B. When A is described to be disposed in B, it means A may be embedded inside B. In the text, when an element or material is described to be non-opaque, it means the element or material can be transparent or translucent.

Figure 1:
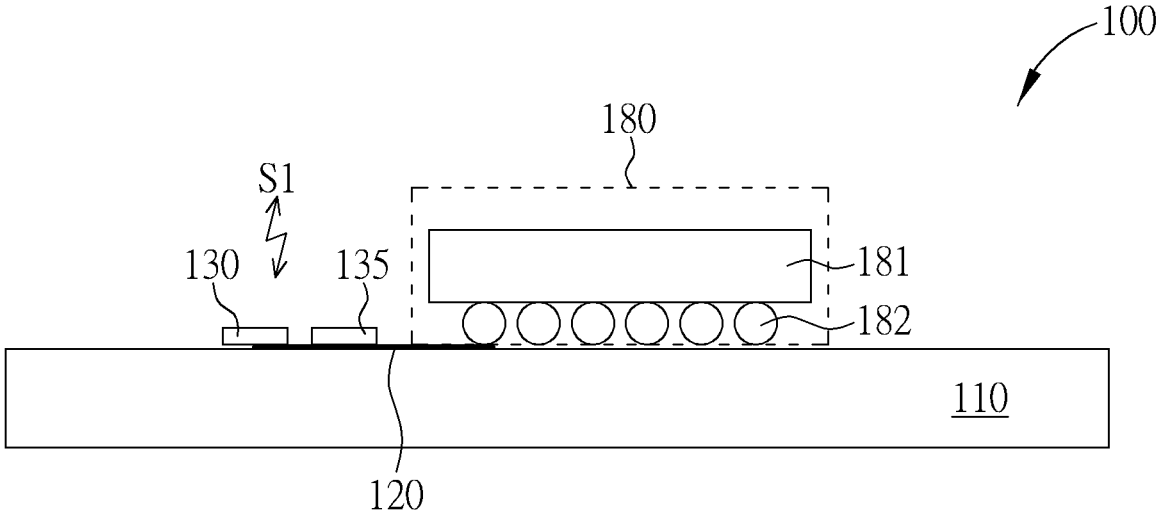
FIG. 1 to FIG. 7 and FIG. 9 to FIG. 11 each illustrate an antenna device according to an embodiment.

FIG. 1 illustrates an antenna device 100 according to an embodiment. The antenna device 100 may include a substrate 110, a feed line 120 and an antenna 130. The substrate 110 is generated with a non-opaque material. The feed line 120 is disposed on the substrate 110 and has a first terminal and a second terminal. The antenna 130 is disposed on the substrate 110, electrically connected to the first terminal of the feed line 120, and used to access a wireless signal S1. The wireless signal S1 has a wavelength less than 100 millimeters. In other words, the wireless signal S1 can be used for millimeter wave (mmWave) communications such as the Fifth Generation (5G) communications. The second terminal of the feed line 120 is electrically connected to a chip 180 disposed on the substrate 110. In FIG. 1, the chip 180 includes a die 181 and a plurality of solder balls 182; and this is merely an example instead of limiting the scope of the embodiment. The chip 180 is used to process the wireless signal S1.

As shown in FIG. 1, the chip 180 and the feed line 120 are disposed on the same face of the substrate 110. In other words, the feed line 120 can be formed on the surface of the substrate 110 so as to integrate the antenna 130, the substrate 110 and the chip 180.

The number of antenna(s) of the antenna device 100 can be one or more. For example, as shown in FIG. 1, there can be another antenna 135 electrically connected to the chip 180 through the feed line 120 or another feed line. The couplings and functions of the antenna 135 and the antenna 130 may be similar, so it is not repeatedly described.

Figure 2:
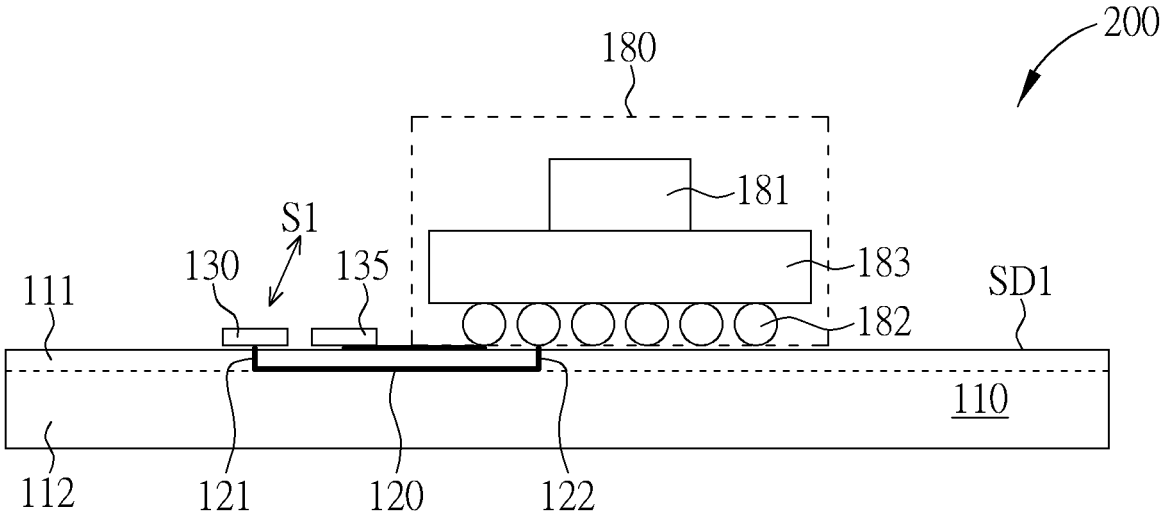

FIG. 2 illustrates an antenna device 200 according to another embodiment. The similar portions of the antenna devices 100 and 200 are not repeatedly described. However, in FIG. 2, the substrate 110 has a first layer 111 and a second layer 112. The feed line 120 is disposed between the first layer 111 and the second layer 112; in other words, the feed line 120 can be embedded in the substrate 110. As shown in FIG. 2, the antenna device 200 can include conductive vias 121 and 122. The conductive via 121 can be formed in the first layer 111 and coupled between the antenna 130 and the first terminal of the feed line 120. The conductive via 122 can be formed in the first layer 111 and coupled between the chip 180 and the second terminal of the feed line 120. As shown in FIG. 2, the chip 180 may include a substrate 183 between the die 181 and the solder balls 182 to fan out and route the conductive paths between the die 181 and the solder balls 182. As shown in FIG. 2, the chip 180 and the antenna 130 are disposed on the same side SD1 of the substrate 110.

Figure 3:
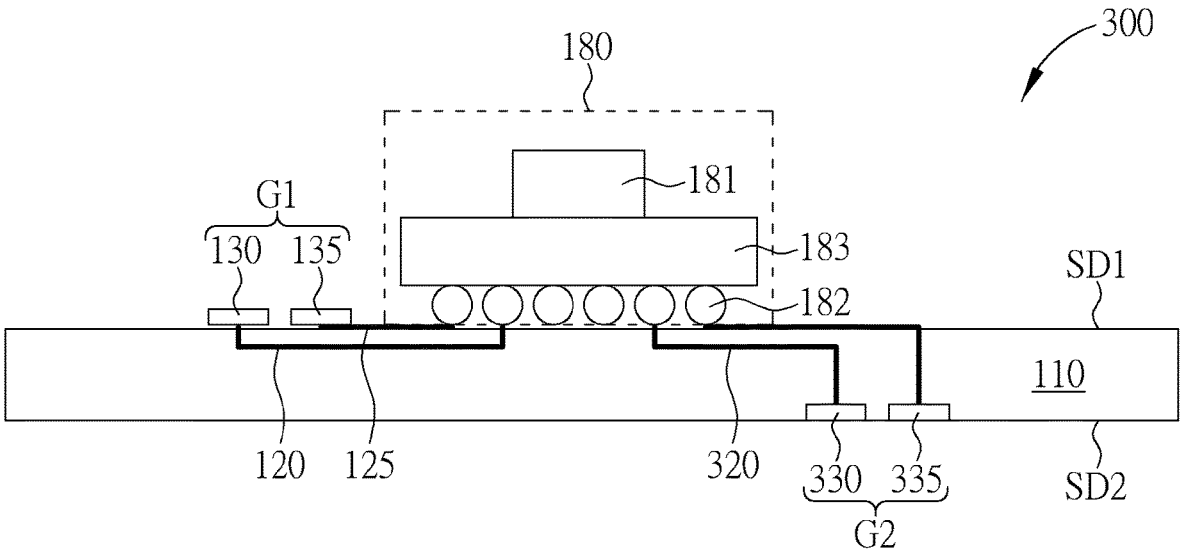

FIG. 3 illustrates an antenna device 300 according to another embodiment. The antenna devices 200 and 300 may be similar; however, the antenna device 300 may further include a feed line 320 and antennas 330 and 335. As shown in FIG. 3, the chip 180 is disposed on a side SD1 of the substrate 110. The antenna 330 is disposed on a side SD2 of the substrate 110. The feed line 320 is disposed in the substrate 110 between the side SD1 and the side SD2. The side SD1 is opposite to the side SD2. For example, the sides SD1 and SD2 may be an upper side and a lower side.

As shown in FIG. 3, the antennas 130 and 135 may be regarded as a first group G1, and the antennas 330 and 335 may be regarded as a second group G2. The chip 180 may be used to process signals accessed by a plurality of groups of antennas. In FIG. 3, the two groups G1 and G2 of antennas are disposed on two different sides; however, according to embodiments, different groups of antennas electrically connected to the chip 180 may be disposed on the same side of the substrate 110.

In FIG. 3, the first group G1 including antennas 130 and 135 may access wireless signals related to a first radiation direction, the second group G2 including antennas 330 and 335 may access wireless signals related to a second radiation direction, and the first radiation direction can be different from the second radiation direction. In other words, the groups G1 and G2 may be regarded as two different antenna systems having different radiation patterns and are used for accessing wireless signals of different radiation directions.

Take antennas 130 and 135 in FIG. 3 as an example, like the antenna 130, the antenna 135 can be coupled to the chip 180 via a feed line 125. For example, the antennas 130 and 135 can form an antenna array to access the same wireless signal. In another example, the antennas 130 and 135 can access different wireless signals, and each of the signals may have a wavelength less than 100 millimeters. According to another embodiment, two antennas of one antenna array can be coupled to the chip 180 via the same feed line, and the feed line can be disposed on the substrate 110 or in the substrate 110.

Figure 4:
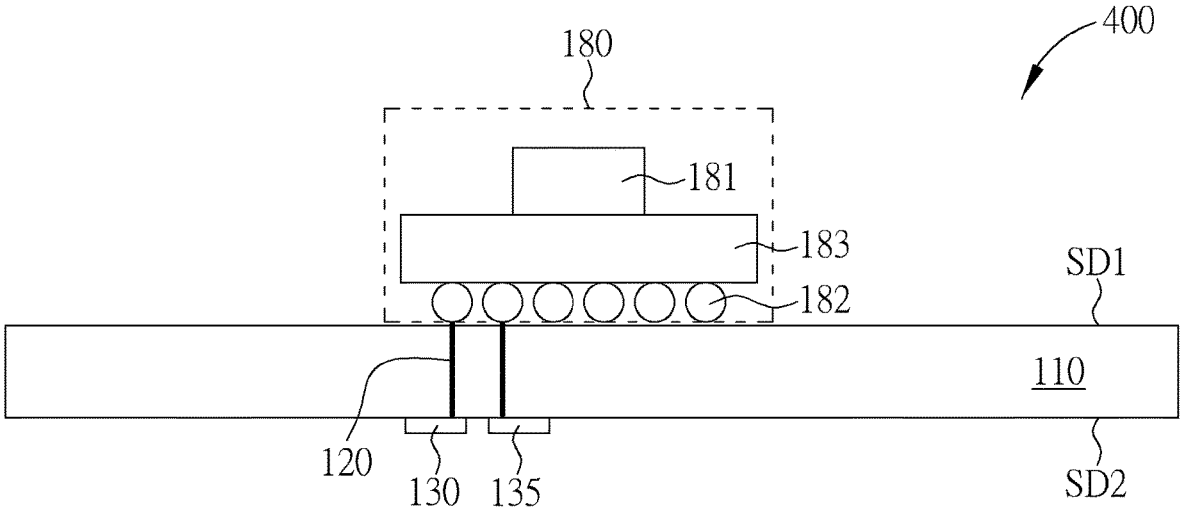

FIG. 4 illustrates an antenna device 400 according to another embodiment. The similarities of the antenna devices 400 and 200 are not repeatedly described. As shown in FIG. 4, the chip 180 is disposed on the side SD1 of the substrate 110, and the antenna 130 is disposed on the side SD2 of the substrate 110. The sides SD1 and SD2 are opposite to one another. The feed line 120 is disposed in the substrate 110 and perpendicular to the side SD1 and the side SD2.

Figure 5:
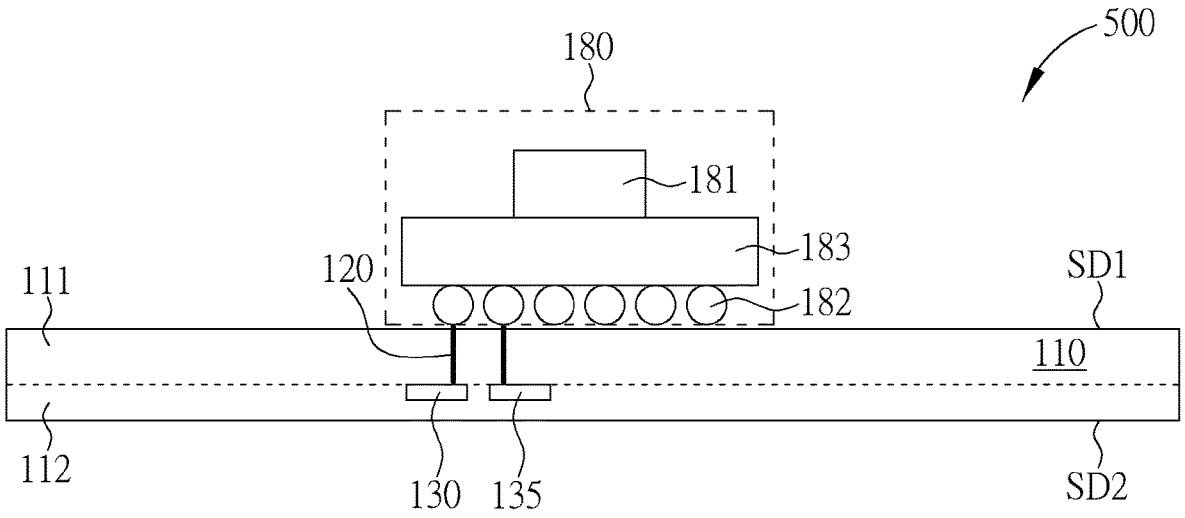

FIG. 5 illustrates an antenna device 500 according to another embodiment. The antenna devices 400 and 500 may be similar. However, in the antenna device 500, the substrate 110 may have a first layer 110 and a second layer 120, and the antenna 130 is disposed between the first layer 111 and the second layer 120. Like the antenna 130, the antenna 135 can also be embedded inside the substrate 110. In other words, the antennas 130 and 135 can be embedded inside the substrate 110. The feed line 120 can be disposed in the substrate 110.

Figure 6:
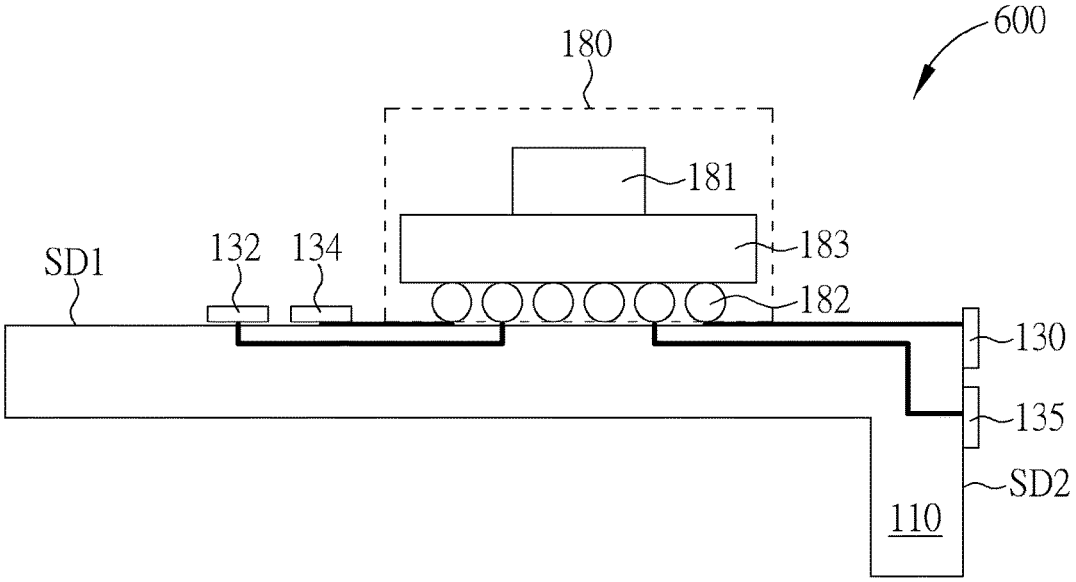

FIG. 6 illustrates an antenna device 600 according to another embodiment. As shown in FIG. 5, the chip 180 is disposed on the side SD1 of the substrate 110. The antenna device 600 has antennas 132, 134, 130 and 135, where the antennas 132 and 134 are of a group, and the antennas 130 and 135 are of another group. The antennas 130 and 135 can be disposed on the side SD2 of the substrate 110, and the sides SD1 and SD2 can share a common edge. For example, when the substrate 110 is a part of a glass screen of a mobile device, the configuration shown in FIG. 6 may improve the flexibility of disposing antennas and assembling the components.

As in FIG. 3, in FIG. 6, the antennas 132 and 134 may form a group corresponding to a first antenna pattern and are used to access wireless signals of a first radiation direction; and the antennas 130 and 135 may form another group corresponding to a second antenna pattern and are used to access wireless signals of a second radiation direction.

Figure 7:
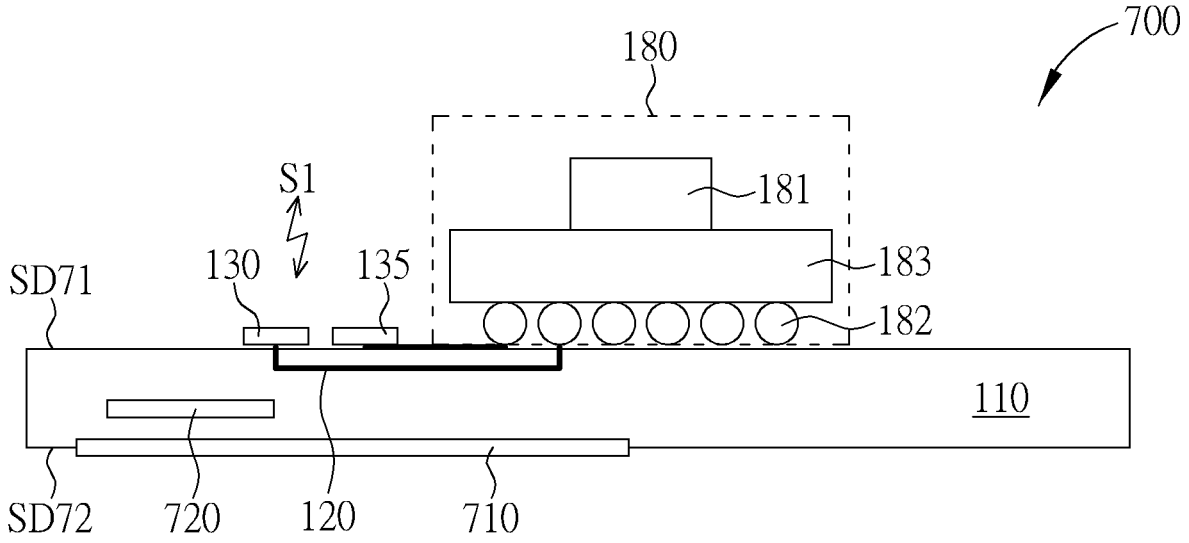

FIG. 7 illustrates an antenna device 700 according to another embodiment. Compared to the antenna devices mentioned above, the antenna device 700 may further include conductive elements 710 and 720. The conductive element 710 can be disposed on a side SD72 of the substrate 110. The conductive element 720 can be disposed inside the substrate 110. Each of the conductive elements 710 and 720 can be used to reflect the wireless signal S1 for improving efficiency of accessing the wireless signal S1. The chip 180 can be disposed on another side SD71 of the substrate 110. In FIG. 7, the sides SD71 and SD72 are opposite to one another; however, this is merely an example instead of limiting the scope of the embodiment. For example, the sides SD71 and SD72 may share an edge according to obtained antenna performance. FIG. 7 merely provides an example, it is allowed to only use the conductive element 710, only use the conductive element 720 or use both of the conductive elements 710 and 720 according to embodiments. Each of the conductive elements 710 and 720 may be a plate or a strip. For example, the conductive elements 710 and 720 and the antenna 130 in FIG. 7 may form a structure similar to a Yagi antenna.

Figure 8:
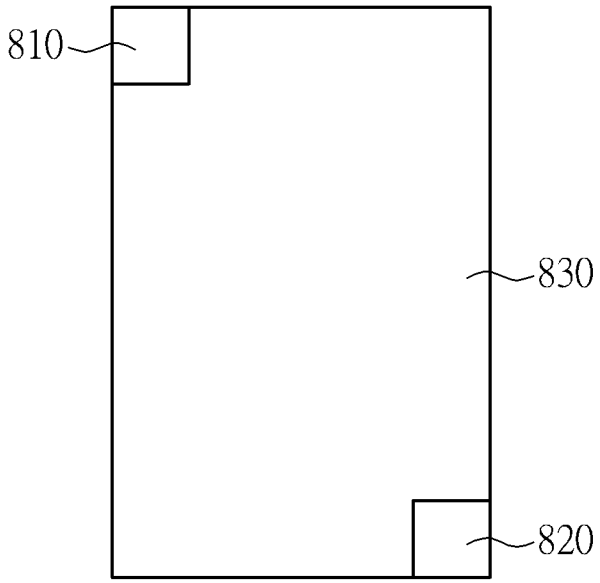
FIG. 8 illustrates two antenna devices disposed on a non-opaque element according to an embodiment.

FIG. 8 illustrates two antenna devices 810 and 820 disposed on a non-opaque element 830 according to an embodiment. Each of the antenna devices 810 and 820 may have features of one of the antenna devices described in FIG. 1 to FIG. 7. As shown in FIG. 8, each of the antenna devices 810 and 820 can be disposed on a corner of the non-opaque element 830. The non-opaque element 830 may be a part of a display, a liquid crystal display module (LCM) or a non-opaque back cover.

For example, when a user holds a mobile phone by hand, the configuration shown in FIG. 8 can avoid the hand from blocking the signals. The performance of accessing the signals can be kept.

In FIG. 8, the non-opaque element 830 may include the substrate 110 mentioned in FIG. 1 to FIG. 7. In other words, for example, each of the antenna shown in FIG. 1 to FIG. 7 may be disposed on a corner of the substrate 110 from a top view.

Regarding the antenna device 810, a chip, a set of antenna(s) and a set of feed wire(s) may be disposed at a corner (e.g. an upper-left corner) of the substrate 110. Regarding the antenna device 820, another chip, another set of antenna(s) and another set of feed wire(s) may be disposed at another corner (e.g. a lower-right corner) of the substrate 110. In other words, the antennas of the antenna devices 810 and 820 can be disposed at the same substrate 110 to be integrated with the same non-opaque element 830.

Figure 9:
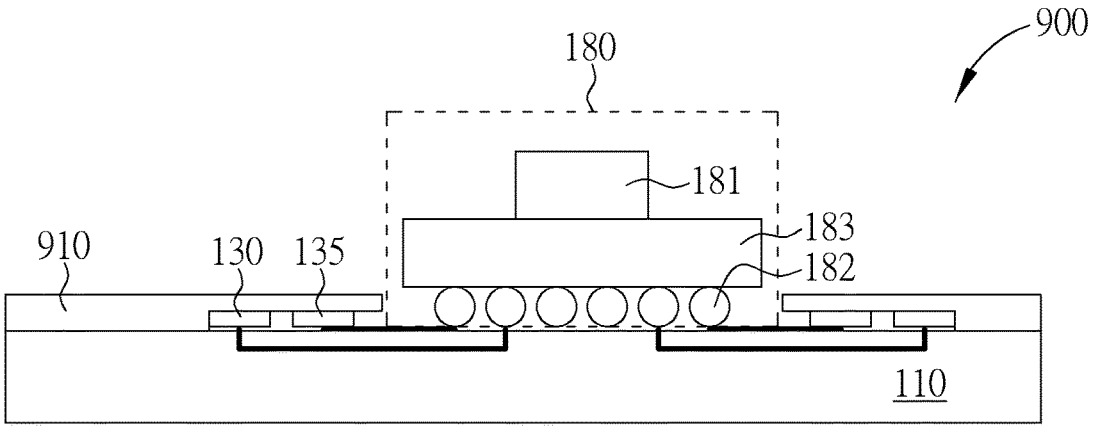

FIG. 9 illustrates an antenna device 900 according to another embodiment. The antenna device 900 may be similar to the antenna device 100 shown in FIG. 1; however, a coating layer 910 can be formed to cover the antenna 130 and is used to improve efficiency of accessing the wireless signal S1. The coating layer 910 may be formed with a meta-material or an electromagnetic band-gap (EBG) material. On a top view, the antenna 130 is disposed in an area, where the area may be fully coated with the material (e.g. the meta-material) of the coating layer 910, or the coating layer 910 may form a pattern of array in the area. For example, the coating layer 910 may be used to improve the radiation pattern or the antenna gain.

Figure 10:
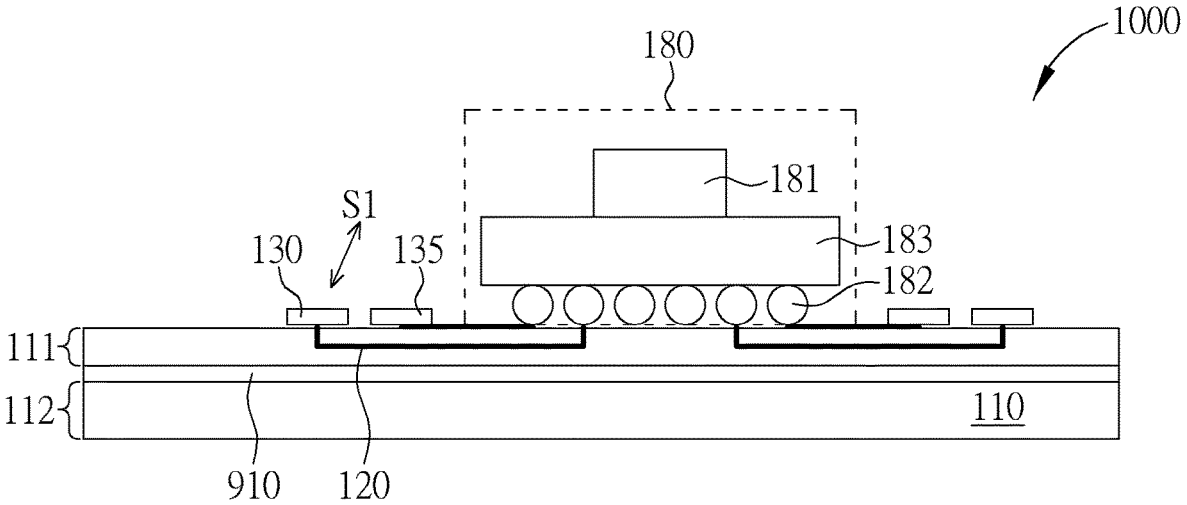

FIG. 10 illustrates an antenna device 1000 according to another embodiment. The antenna device 1000 may be similar to the antenna device 900 of FIG. 9; however, in the antenna device 1000, the coating layer 910 is disposed in the substrate 110. As shown in FIG. 10, the substrate 110 can include a first layer 111 and a second layer 112. The coating layer 910 can be formed between the layers 111 and 112, and be used to improve efficiency of accessing the wireless signal S1. In this case, the coating layer 910 may overlap the antenna 130 in a projection direction.

According to embodiments, the coating layer covering the substrate 110 and the antenna 130 and another coating layer embedded inside the substrate 110 can be used alone or together.

Figure 11:
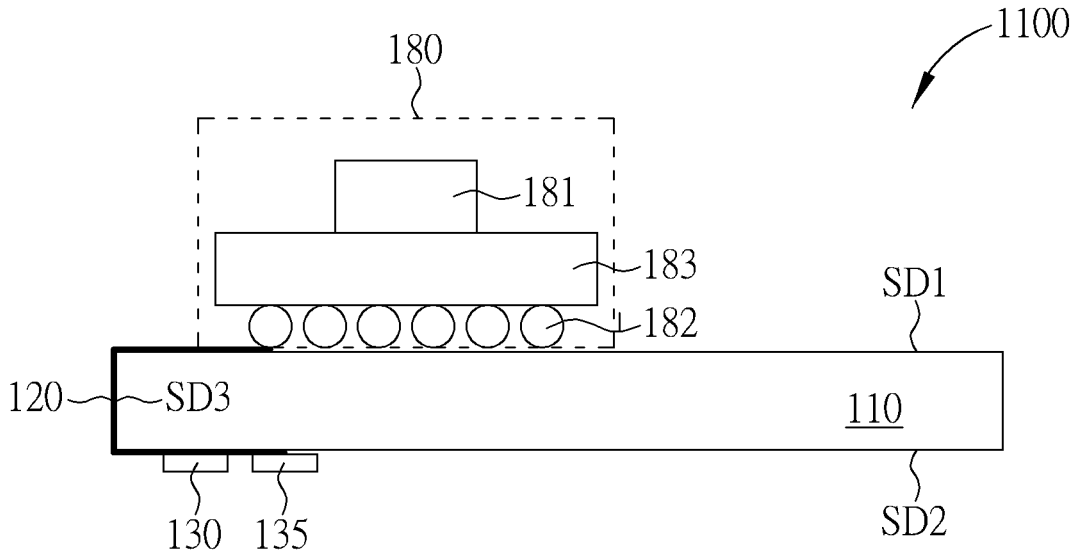

FIG. 11 illustrates an antenna device 1100 according to another embodiment. The antenna device 1100 may be similar to the antenna device 100 in FIG. 1; however, the positions of the antenna can be different. As shown in FIG. 11, the substrate 110 has a side SD1, a side SD2 opposite to the side SD1, and a side SD3 having a common edge with the side SD1 and another common edge with the side SD2. The chip 180 can be disposed on the side SD1. The antennas 130 and 135 can be disposed on the side SD2. As shown in FIG. 11, the feed line 120 can include a first section on the side SD1, a second section on the side SD3 and a third section on the side SD2.

In FIG. 1 to FIG. 11, according to embodiments, the non-opaque material of the substrate 110 can have a dielectric constant between 3 and 4. The non-opaque material can have a loss tangent less than a predetermined value.

In FIG. 1 to FIG. 11, according to embodiments, the non-opaque material of the substrate 110 may include glass, copper clad laminate and/or liquid crystal polymer (LCP) to be integrated with a (conductive) feed line and an antenna, and be integrated with a display and/or a non-opaque back cover.

According to embodiments, in FIG. 1 to FIG. 11, the chip 180 can be bonded onto the substrate 110 with a plurality of solder balls 182 of the chip 180. A plurality of conductive interfaces can be formed on the substrate 110 for the solder balls 182 to be bonded and electrically connected to the feed line(s) coupled to the antenna(s).

In summary, by means of the antenna devices provided by embodiments, the antennas and feed lines can be better integrated with a non-opaque substrate. The flexibility of disposing antenna(s) and feed line(s) can be improved. The whole volume of the system can be reduced, and the antenna performance can be enhanced. The antenna radiation coverage can be increased. A solution is provided to solve the problems of the field.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An antenna device comprising:

a substrate generated with a non-opaque material, and comprising a first layer and a second layer;

a first feed line disposed at the substrate and between the first layer and the second layer of the substrate, comprising a first terminal and a second terminal;

a first antenna disposed at the substrate, electrically connected to the first terminal of the first feed line, and configured to access a first wireless signal;

a first conductive via formed in the substrate and coupled between the first antenna and the first terminal of the first feed line; and a second conductive via formed in the substrate and coupled between a chip disposed on the substrate and the second terminal of the first feed line;

wherein the second terminal of the first feed line is electrically connected to the chip.

2. The antenna device of claim 1, wherein the chip and the first feed line are disposed on a same face of the substrate.

3. The antenna device of claim 1, wherein the chip and the first antenna are disposed on a same side of the substrate.

4. The antenna device of claim 1, wherein the chip is disposed on a first side of the substrate, the first antenna is disposed on a second side of the substrate, the first feed line is disposed in the substrate between the first side and the second side, and the first side is opposite to the second side.

5. The antenna device of claim 1, wherein the chip is disposed on a first side of the substrate, the first antenna is disposed on a second side of the substrate, and the first feed line is disposed in the substrate and perpendicular to the first side and the second side.

6. The antenna device of claim 1, wherein the substrate comprises a first layer and a second layer, the first antenna is disposed between the first layer and the second layer, and the first feed line is disposed in the substrate.

7. The antenna device of claim 1, wherein the chip is disposed on a first side of the substrate, the first antenna is disposed on a second side of the substrate, and the first side and the second side share a common edge.

8. The antenna device of claim 1 further comprising a conductive element disposed on a side of the substrate and configured to reflect the first wireless signal for improving efficiency of accessing the first wireless signal, wherein the chip is disposed on another side of the substrate.

9. The antenna device of claim 1, further comprising a conductive element disposed inside the substrate and configured to reflect the first wireless signal for improving efficiency of accessing the first wireless signal.

10. The antenna device of claim 1, further comprising:

a second feed line disposed at the substrate, comprising a first terminal and a second terminal coupled to the chip; and a second antenna electrically connected to the first terminal of the second feed line.

11. The antenna device of claim 10, wherein the first antenna and the second antenna form an antenna array to access the first wireless signal.

12. The antenna device of claim 10, wherein the first wireless signal is related to a first radiation direction, the second antenna is configured to access a second wireless signal related to a second radiation direction, and the first radiation direction is different from the second radiation direction.

13. The antenna device of claim 1, wherein first antenna is disposed on a corner of a non-opaque element from a top view, and the non-opaque element comprises the substrate.

14. The antenna device of claim 1, further comprising a coating layer formed to cover the first antenna and configured to improve efficiency of accessing the first wireless signal.

15. The antenna device of claim 1, wherein the substrate comprises a first layer and a second layer, and the antenna device further comprises a coating layer formed between the first layer and the second layer and configured to improve efficiency of accessing the first wireless signal.

16. The antenna device of claim 1, wherein the non-opaque material has a dielectric constant between 3 and 4.

17. The antenna device of claim 1, wherein the non-opaque material comprises glass and/or copper clad laminate.

18. The antenna device of claim 1, wherein the first wireless signal has a wavelength less than 100 millimeters.

19. An antenna device comprising:

a substrate generated with a non-opaque material;

a first feed line disposed at the substrate, comprising a first terminal and a second terminal; and a first antenna disposed at the substrate, electrically connected to the first terminal of the first feed line, and configured to access a first wireless signal;

wherein the second terminal of the first feed line is electrically connected to a chip disposed on the substrate;

wherein:

the substrate has a first side, a second side opposite to the first side, and a third side having a common edge with the first side and another common edge with the second side;

the chip is disposed on the first side;

the first antenna is disposed on the second side; and the first feed line comprises a first section on the first side, a second section on the third side and a third section on the second side.

* * * * *